US006332827B1

(12) United States Patent
Gottschald et al.

(10) Patent No.: US 6,332,827 B1
(45) Date of Patent: Dec. 25, 2001

(54) APPARATUS FOR MACHINING GLASS LENSES

(75) Inventors: Lutz Gottschald, Meerbusch; Jörg Luderich, Ratingen, both of (DE)

(73) Assignee: Wernicke & Co. GmbH, Düsseldorf (DE)

( * ) Notice: Subject to any disclaimer, the term of this patent is extended or adjusted under 35 U.S.C. 154(b) by 0 days.

(21) Appl. No.: 09/601,750

(22) PCT Filed: Jan. 27, 1999

(86) PCT No.: PCT/EP99/00513

§ 371 Date: Aug. 7, 2000

§ 102(e) Date: Aug. 7, 2000

(87) PCT Pub. No.: WO99/39870

PCT Pub. Date: Aug. 12, 1999

(30) Foreign Application Priority Data

Feb. 5, 1998 (DE) ..... 198 04 489

(51) Int. Cl.[7] ..... B24B 49/00; B24B 51/00

(52) U.S. Cl. ..... 451/6; 451/41

(58) Field of Search ..... 451/41, 42, 43, 451/5, 6, 8, 9, 57, 256, 255

(56) References Cited

U.S. PATENT DOCUMENTS 5,588,899 * 12/1996 Gottschald ..... 451/5
5,727,987 * 3/1998 Gottschald ..... 451/5
5,908,348 * 6/1999 Gottschald ..... 451/5

FOREIGN PATENT DOCUMENTS 4414784 11/1995 (DE) .
19527222 1/1997 (DE) .
19537692 4/1997 (DE) .

* cited by examiner

*Primary Examiner*—Derris H. Banks
(74) *Attorney, Agent, or Firm*—Ostrolenk, Faber, Gerb & Soffen

(57) ABSTRACT

The present invention relates to an apparatus for machining glass lenses, wherein said apparatus comprises the following members: a housing; a machining chamber located in said housing; a shaft for maintaining a glass lens and a machining device both arranged in the machining chamber; a cover for outwardly closing the machining chamber; a support for transporting a non-machined lens towards the shaft for maintaining the glass lens when the cover is shut; a detector for measuring the position of the non-machined lens as well as its angular position on the support, said detector being located in the area between the cover and the shaft for maintaining the glass lens; and a control device in the form of a computer. When grinding the glass lens using the machining device, the control device uses the data provided by the detector about the situation and the angular position of the non-machined lens in the shaft for maintaining the glass lens.

6 Claims, 1 Drawing Sheet

APPARATUS FOR MACHINING GLASS LENSES

Figure 2:
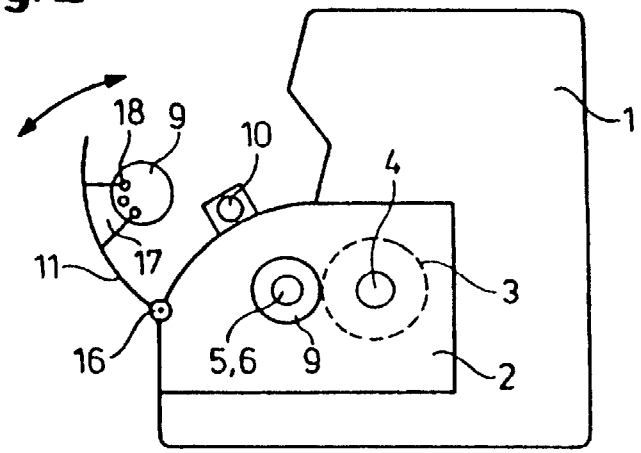

The invention relates to spectacle lens machining apparatus, in particular a spectacle lens edging machine, having a housing, a machining chamber in the housing, a spectacle lens holding shaft, a flap outwardly sealing the machining chamber, a holder which, upon closure of the flap, transports a rough-cast lens into the region of the spectacle lens holding shaft, and a sensor for detecting the presence and/or the angular position of the rough-cast lens.

Such an apparatus is described in DE 195 37 692 C2 of the same applicant. In the case of this apparatus, the holder has pincers which grip the rough-cast lens on its circumference at diametrically opposite points, or grip a block or sucker mounted on the rough-cast lens, such that the rough-cast lens can be brought with its optical axis into the axis of the spectacle lens holding shaft in an accurately positioned fashion. In accordance with another embodiment, it is possible for there to be present on the holder a controllable suction device acting on a region of an optical surface of the rough-cast lens outside the region of the surface required for holding the rough-cast lens on the spectacle lens holding shaft, such that with the flap folded open it is possible for a rough-cast lens to be inserted into the pincers on the flap or on the suction device. With this known device, the insertion of the rough-cast lens into the pincers on the flap or on the suction device on the flap must be performed so accurately with regard to the optical midpoint of the rough-cast lens that the rough-cast lens held by the holder passes into the region of the spectacle lens holding shaft when the flap is folded back into the closed position, and the optical axis of the rough-cast lens coincides with the axis of rotation of the spectacle lens holding shaft. The rough-cast lens is then taken over by the spectacle lens holding shaft and can be further machined in the usual way.

A sensor arranged in the machine chamber can be used to detect both the presence of a rough-cast lens in the region of the spectacle lens holding shaft and the angular position of the rough-cast lens, it thereby being possible for the spectacle lens holding shaft to be driven by means of this sensor such that it takes over the rough-cast lens accurately in angular terms. The operator can therefore insert the rough-cast lens into the holder without having to take account of the angular position of the rough-cast lens, but, as already mentioned, the rough-cast lens must be inserted into the holder with regard to its optical axis so accurately that this optical axis of the rough-cast lens corresponds to the axis of rotation of the spectacle lens holding shaft when the rough-cast lens is clamped by means of the spectacle lens holding shaft.

DE 195 27 222 C2 of the same applicant discloses, furthermore, an installation for grinding at least the circumferential edge of spectacle lenses, and a method for taking account by computer of the position of a rough-cast lens held on a holding head of the installation. In this case, the position of a rough-cast lens mounted on a holding head of a rotatable shaft of a CNC-controlled installation for grinding spectacle lenses in accordance with a prescribable outline of the respective spectacle lens is taken into account by computer in such a way that the position of the rough-cast lens, held on the holding head, with regard to the optical axis with reference to the axis of the rotatable shaft and/or the axial position of a cylindrical or prismatic cut, or with regard to conventional markings on the rough-cast lens is measured by means of a detection device which converts measured values into electric signals by means of a converter, the signals are input into the control device, constructed as a computer, of the installation, and the signals are incorporated by calculation into the prescribed outline of the spectacle lens, if appropriate into the axial position of a cylindrical or prismatic spectacle lens and/or into the decentration values in the case of CNC-controlled grinding of the spectacle lens.

In the case of this installation, the detection device is arranged coaxially with the holding shaft, which is constructed as a hollow shaft, and preferably consists of a CCD camera.

Both the spectacle lens machining apparatus in accordance with DE 195 37 692 C2, and the installation in accordance with DE 195 27 222 C2 have proved themselves, but it has emerged that it is desirable to simplify the mounting of a rough-cast lens onto a holder on a flap, and to avoid a complicated detection device coaxial with a hollow spectacle lens holding shaft.

Consequently, the problem on which the invention is based is to create a spectacle lens machining apparatus in the case of which no particular requirements are placed on the skill and accuracy of an operator when inserting a rough-cast lens which is to be machined into the apparatus, the aim being that the apparatus should be of simple design and reliable in manipulation.

Starting from this formation of the problem, it is proposed in the case of a spectacle lens machining apparatus of the type mentioned at the beginning to provide it with a sensor, which measures the position of the rough-cast lens and its angular position on the holder, in the region between the flap and the spectacle lens holding shaft, and with a control device, constructed as a computer, which takes account, by computer using the sensor data, of the position and angular position of the rough-cast lens in the spectacle lens holding shaft during form grinding of the spectacle lens by means of the machining apparatus.

The invention proceeds from the consideration that the position and angular position of the rough-cast lens in the spectacle lens holding shaft are determined by the position and angular position on the holder, and that as the flap swings-in, the rough-cast lens moves on a geometrically predetermined track, with the result that it suffices to measure the position and angular position of the rough-cast lens on the holder in the region between the starting position of the rough-cast lens on the holder with the flap folded open and the spectacle lens holding shaft before the rough-cast lens is taken over by the spectacle lens holding shaft, and take account of this measured value by computer when machining the spectacle lens.

It is therefore sufficient to mount the rough-cast lens by hand on the holder on the flap with the flap open in a fashion requiring little skill and accuracy on the part of the operator, and then close the flap so that the spectacle lens holding shaft can take over the rough-cast lens, the position and the angular position of the rough-cast lens being measured and taken into account by computer.

The sensor can preferably be constructed as a CCD camera which is arranged on the flap or in the swiveling path of the rough-cast lens on the flap outside or inside the grinding chamber.

When the sensor is arranged on the flap, the position and angular position of the rough-cast lens can be determined directly with reference to the holder and be forwarded to the computer of the control device. In this case, the CCD camera moves with the flap and is located in the machining chamber during the machining of the spectacle lens.

If the sensor is arranged fixed on the housing of the spectacle lens machining apparatus in the swiveling path of the rough-cast lens on the flap outside or inside the machining chamber, it is advantageous to arrange an angle sensor, which is connected to the control device, on a hinge for the flap, with the result that the measurement of the position and the angular position of the rough-cast lens on the holder is always triggered by the angle sensor in a specific angular position which can be related to the position and angular position of the rough-cast lens in the spectacle lens holding shaft.

Figure 3:
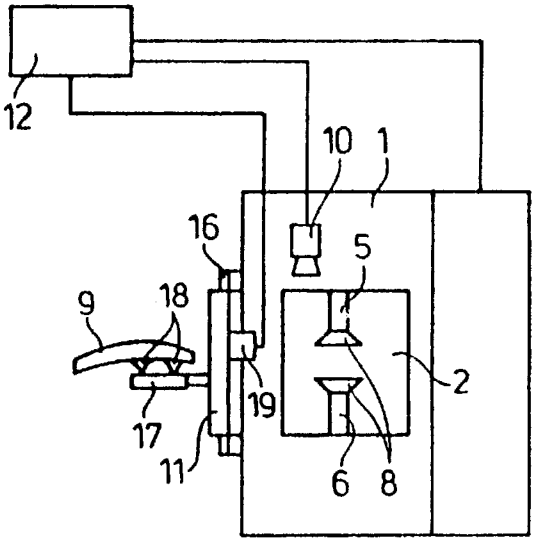
Figure 1:
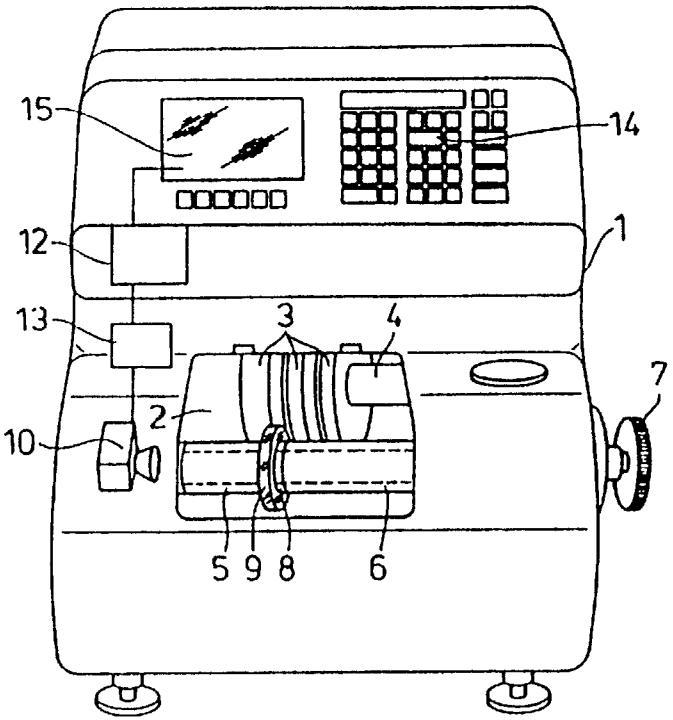

The invention is explained in more detail below with the aid of an exemplary embodiment illustrated in the drawing, in which:

FIG. 1 shows a front view of a spectacle lens machining apparatus constructed as a spectacle lens edging machine, FIG. 2 shows a diagrammatic side view, partially in section, of the spectacle lens machining apparatus in accordance with FIG. 1, and FIG. 3 shows a diagrammatic plan view of the spectacle lens machining apparatus in accordance with FIG. 1.

Of a CNC-controlled spectacle lens edging machine which is known per se, the figure illustrates a housing 1 in whose grinding chamber 2 three grinding wheels 3 are arranged on a shaft 4. One of the grinding wheels with a cylindrical surface serves for pregrinding the outline of a spectacle lens, while the two further grinding wheels serve for incipiently grinding different top bevels on the preground spectacle lens.

Arranged parallel to the shaft 4 with the grinding wheels 3 is a spectacle lens holding shaft in the form of coaxial half-shafts 5, 6, of which the half-shaft 6 is axially displaceable. The half-shafts 5, 6 have on their ends annular holding heads 8 between which a rough-cast lens 9 can be clamped. The clamping can be performed automatically or via a handle 7.

The grinding of the circumferential edge according to a prescribed shape of the spectacle lens is performed in a known way by means of a control device 12 in a CNC-controlled fashion. The control device 12 is connected to an input device 14 in the form of a keyboard, by means of which it is possible to input the prescribed outline, the decentration values and, if appropriate, the axial position of a cylindrical or prismatic cut.

The input data and the outline of a spectacle lens to be form-ground can be illustrated on a screen 15.

Arranged on the housing 1 outside the grinding chamber 2 is a sensor 10 in the form of a CCD camera, which is connected via a converter 13 to the computer of the control device 12. A flap 11 serves to seal the grinding chamber 2 during the machining of the spectacle lens. The flap 11 is pivoted to the housing 1 by means of a hinge 16. A holder 17 with suction heads 18 is located on the flap 11. The rough-cast lens 9 can be mounted on this holder 17 in such a way that the suction heads 18 act on the rough-cast lens 9 outside the region of the surface required for holding the rough-cast lens 9 on the spectacle lens holding shaft 5, 6. This mounting of the rough-cast lens 9 on the suction heads 18 on the holder 17 requires no great skill and accuracy if it is ensured that the rough-cast lens is inserted and clamped between the half-shafts 5, 6 with such a position of its optical axis with reference to the axis of rotation of the spectacle lens holding shaft 5, 6 that the deviations are situated within a permitted tolerance range. The position of the rough-cast lens 9 and its angular position on the holder 17 are measured by the CCD camera.

In the exemplary embodiment illustrated, three suction heads 18 are illustrated, but of course it is also possible to provide more than three or less than three, for example only one suction head.

In the exemplary embodiment illustrated, the CCD camera 10 is arranged on the housing 1 outside the grinding chamber 2 in the region of the swiveling path of the rough-cast lens 9, as may be seen in FIG. 2. An angle sensor 19 on the flap 11, which is likewise connected to the computer of the control device 12, triggers a measurement by the CCD camera 10, when the rough-cast lens 9 is located in front of the CCD camera 10 when being swung-in. With regard to its axial position and angular position, the image of the rough-cast lens 9 is converted by means of an image evaluation system coupled to the CCD camera 10 into computer-usable data such that the computer in the control device 12 is capable of using this data to reach a conclusion on the position and angular position of the rough-cast lens between the halfshafts 5, 6, and of incorporating this position and angular position into the control program for form grinding of the spectacle lens by calculation. Instead of aligning the rough-cast lens in the spectacle lens holding shaft accurately, in the case of the spectacle lens machining apparatus according to the invention the position and angular position of the rough-cast lens are taken into account in the spectacle lens holding shaft 5, 6 by computer.

The CCD camera can also be arranged in the flap 11, with the result that it moves with the flap 11. In this case, the angle sensor 19 is not required, since the CCD camera 10 assumes on the flap 11 a position defined relative to the holder 17 and the rough-cast lens 9 mounted thereon.

Furthermore, the CCD camera 10 can also be arranged in the grinding chamber 2 in the region of the swiveling movement of the rough-cast lens 9 when an arrangement outside the grinding chamber 2 on the housing 1 is unfavorable.

The invention is not limited to the use of a CCD camera 10 as sensor for the position and angular position of a rough-cast lens which are to be measured, but, rather, any type of optoelectronic sensor which supplies data which can be used by a computer is suitable.

What is claimed is:

1. A spectacle lens machining apparatus, having a housing, a machining chamber in the housing, a spectacle lens holding shaft and a machining device in the machining chamber, a flap outwardly sealing the machining chamber when the flap is in a closed position, a lens holder cooperating with the flap which, upon closure of the flap from an open position to the closed position, transports a rough-cast lens held on the lens holder into the region of the spectacle lens holding shaft, a sensor which measures sensor data including the position of the rough-cast lens and its angular position on the holder, in the region between the flap in the open position and the spectacle lens holding shaft, and a control device which is constructed as a computer and takes account of the position and angular position of the rough-cast lens in the spectacle lens holding shaft by computer using the sensor data when machining the spectacle lens by means of the machining apparatus.

2. The spectacle lens machining apparatus as claimed in claim 1, in which the sensor is constructed as a CCD camera.

3. The spectacle lens machining apparatus as claimed in claim 1, in which the sensor is arranged on the flap.

4. The spectacle lens machining apparatus as claimed in claim 1, in which the sensor is arranged in the swiveling region of the rough-cast lens mounted on the flap, next to the flap outside the machining chamber.

5. The spectacle lens machining apparatus as claimed in claim 1, in which the sensor is arranged in the swiveling region of the rough-cast lens mounted on the flap, inside the machining chamber.

6. The spectacle lens machining apparatus as claimed in claim 4, in which an angle sensor is arranged on a hinge for the flap and connected to the control device.

* * * * *